US008182712B1

(12) United States Patent
Maekawa et al.

(10) Patent No.: US 8,182,712 B1
(45) Date of Patent: May 22, 2012

(54) METHODS AND APPARATUS FOR DYEING MATERIAL

(75) Inventors: Maki Maekawa, Kanagawa (JP); Takahisa Kusuura, Kanagawa (JP)

(73) Assignee: Empire Technology Development LLC, Wilmington, DE (US)

( * ) Notice: Subject to any disclaimer, the term of this patent is extended or adjusted under 35 U.S.C. 154(b) by 0 days.

(21) Appl. No.: 13/133,614

(22) PCT Filed: Jan. 12, 2011

(86) PCT No.: PCT/JP2011/050800

§ 371 (c)(1),
(2), (4) Date: Aug. 15, 2011

(51) Int. Cl.
*H01F 1/00* (2006.01)

(52) U.S. Cl. ..... 252/62.51; 252/62.52; 252/62.53; 252/62.54; 252/62.55; 252/62.57

(58) Field of Classification Search ..... 252/62.51, 252/62.52, 62.53, 62.54, 62.55, 62.57
See application file for complete search history.

(56) References Cited

U.S. PATENT DOCUMENTS

| | | | | |
|---|---|---|---|---|
| 4,026,713 | A | 5/1977 | Sambucetti et al. | |
| 4,315,267 | A | 2/1982 | Sonoda et al. | |
| 4,508,752 | A | 4/1985 | Takei et al. | |
| 4,519,931 | A * | 5/1985 | Soga et al. | 252/62.51 R |
| 4,702,742 | A | 10/1987 | Iwata et al. | |
| 5,670,077 | A | 9/1997 | Carlson et al. | |
| 5,804,095 | A | 9/1998 | Jacobs et al. | |
| 5,900,184 | A | 5/1999 | Weiss et al. | |
| 6,027,664 | A | 2/2000 | Weiss et al. | |
| 6,221,138 | B1 | 4/2001 | Kenny | |
| 6,273,265 | B1 | 8/2001 | Greenwalt | |
| 2008/0192105 | A1 | 8/2008 | Sembower et al. | |

FOREIGN PATENT DOCUMENTS

| | | |
|---|---|---|
| DE | 2623508 | 12/1976 |
| DE | 2831797 A1 | 2/1979 |
| EP | 0073570 A2 | 3/1983 |
| EP | 0980080 A1 | 2/2000 |
| EP | 1958768 A3 | 8/2008 |
| GB | 1516956 | 7/1978 |
| GB | 2001284 B | 1/1979 |
| JP | 52-505 | 5/1977 |
| JP | 54-023534 | 2/1979 |
| JP | 58-021464 | 2/1983 |
| JP | 06-100876 | 4/1994 |
| JP | 07-018192 | 1/1995 |
| JP | 11-513191 | 9/1999 |
| JP | 11-513192 | 9/1999 |
| JP | 2004-074332 | 3/2004 |
| JP | 2006-152454 | 6/2006 |
| JP | 2008-056830 | 3/2008 |

(Continued)

OTHER PUBLICATIONS

International Search Report and Written Opinion, PCT/JP2011/050800, dated Mar. 1, 2011.

(Continued)

*Primary Examiner* — Eisa Elhilo
(74) *Attorney, Agent, or Firm* — Pepper Hamilton LLP

(57) ABSTRACT

Techniques for dyeing material are disclosed, including providing a magnetorheological fluid containing a coloring agent onto a contacting surface, applying a magnetic field to the magnetorheological fluid to increase viscosity of the magnetorheological fluid, and contacting the material with the magnetorheological fluid on the contacting surface to dye the material with the coloring agent.

25 Claims, 9 Drawing Sheets

FOREIGN PATENT DOCUMENTS

| | | |
|---|---|---|
| JP | 2008-195071 | 8/2008 |
| WO | WO97/15057 A1 | 4/1997 |
| WO | WO97/15058 A1 | 4/1997 |

OTHER PUBLICATIONS

Lin, et al., Fabrication of silicon mirror with ultraprecision synergistic finishing process of ELID-grinding and MRF, *Journal of the Japan Society for Abrasive Technology* (Dec. 2005) vol. 49(12):701-702.

Ohmori, et al., Study on ultraprecision synergistic finishing process of ELID-grinding and MRF, *Journal of the Japan Society for Abrasive Technology* (Jan. 2006), 50(1):39-44.

http://www.tech-faq.com/magnetorheological-fluid.html, Magnetorheological Fluid from TopBits.com (Printed from internet Mar. 21, 2011).

http://en.wikipedia.org/wiki/Magnetorheological_fluid, Magnetorheological Fluid from Wikipedia.org (Printed from internet Mar. 21, 2011).

Turczyn, et al., Preparation and study of model magnetorheological fluids, *JAMME* (Apr. 2008), 27(2):131-134.

http://en.wikipedia.org/wiki/Cobalt, Article on Cobalt printed from Wikipedia on Mar. 21, 2011.

http://en.wikipedia.org/wiki/Nickel, Article on Nickel printed from Wikipedia on Mar. 21, 2011.

Kiwamu, Cotton textile dyeing technique using supercritical carbon dioxide fluid, http://www.pref.okayama.jp/sangyo/kougi/publishment/news/pdf/451/p03.pdf (Printed from internet Apr. 5, 2011) (English translation provided).

Jacobs, et al., Development of New Magnetorheological Fluids for Polishing CaF2 and KDP, *LLE Review*, (1999), vol. 80, 213-219.

Ohashi, et al., Development of a Variable Damping-Force Damper Using an MR Fluid and its Application to Vibration Isolation Control, *Ryutai Rikigaku Koenkai Koenshu*, (2004), vol. 26, 239-242 (English translation provided).

Michael Dye Seal, Website Citation (printed from internet May 20, 2011) http://mimura.honesto.net/how/mikasil.html (with English machine translation).

Types of Dyes, Website Citation (printed from internet May 20, 2011) http://www.ecosci.jp/color/dye.html (with English machine translation).

* cited by examiner

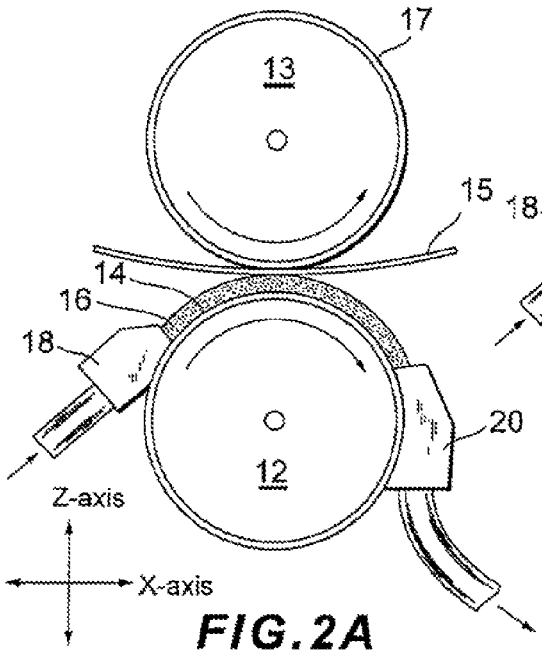
FIG.2A
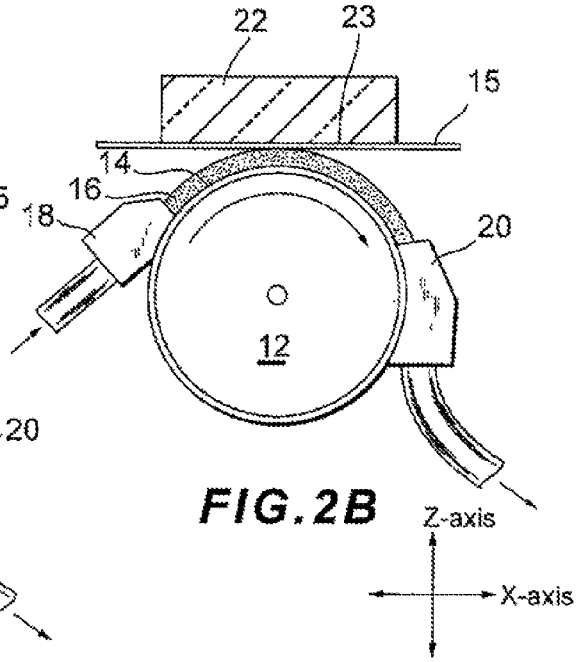
FIG.2B
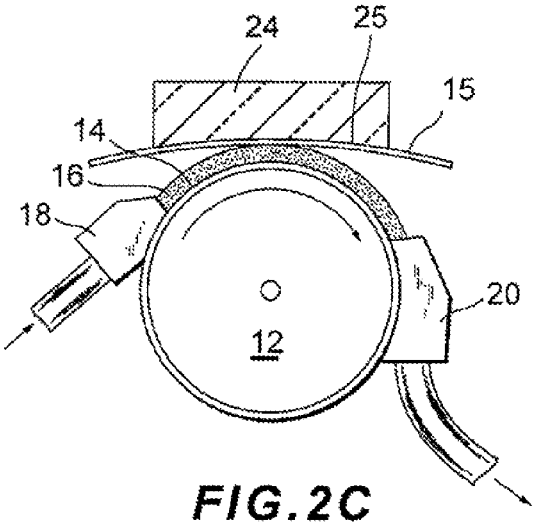
FIG.2C
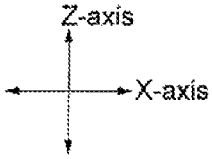

METHODS AND APPARATUS FOR DYEING MATERIAL

CROSS-REFERENCE TO RELATED APPLICATIONS

This application is a U.S. national stage filing under 35 U.S.C. §371 of International Application No. PCT/JP2011/050800 filed Jan. 12, 2011 entitled "Methods and Apparatus for Dyeing Material," the disclosure of which is incorporated by reference in its entirety.

TECHNICAL FIELD

The present disclosure relates to methods for dyeing material and an apparatus for dyeing the material.

BACKGROUND

A common example of fabric processing is dyeing. In such a process, woven or non-woven fabric is usually soaked in a solution in which a coloring agent such as a dye is dissolved or dispersed, so that the coloring agent is able to diffuse into and adsorb onto the fabric. In order to achieve high color fastness, distributing a coloring agent through fabric is desirable for most dyeing processes.

Water has conventionally been used as a solvent in most dyeing processes. As a result, the dyeing industry consumes a large amount of water. Further, the processes to prepare the fiber before dyeing such as bleaching and whitening also consume a large amount of water. This water usage also results in the problem of pollution in water environments. It is desirable to reduce the amount of water used and/or the amount of waste liquid produced, and optionally that coloring agents and/or other components are able to be reused.

Further, fabrics to be dyed include those made by weaving fibers and those having uneven properties (e.g., uneven hydrophilicity). As it is difficult for such fabrics to be dyed evenly, a technique using a dyeing assistant may typically be used. In the technique, a solution for dyeing is made by way of mixing the dyeing assistant and a solvent containing a large amount of high-concentration coloring agent so as to evenly dye the fabric. This technique causes a large amount of coloring agent to remain in the waste liquid without being used for dyeing, further increasing the environmental burden of the industrial process.

SUMMARY

According to an aspect of a method for dyeing material such as, but not limited to, fabric and textile herein, magnetorheological (hereafter referred to as "MR") fluid is provided to a contacting surface. The MR fluid comprises at least one coloring agent and magnetic particles. A magnetic field is applied to the MR fluid to increase viscosity of the MR fluid. The MR fluid makes contact with the material on the contacting surface to help dye the material with the coloring agent to produce a dyed material.

An apparatus for dyeing material, including at least one providing device, at least one contacting surface and at least one opposing surface are disclosed. The providing device is configured to provide a MR fluid onto the contacting surface. The contacting surface is configured to apply a magnetic field to the MR fluid to increase viscosity of the MR fluid. The opposing surface, which opposes to the contacting surface, is configured to contact the material with the MR fluid on the contacting surface to dye the material with the coloring agent.

The magnetic field may generally be created by any one or more types of magnet. Two examples of magnets are an electromagnet or a permanent magnet. The magnetic field may be created by a single magnet or by multiple magnets. The dyeing apparatus can further comprise a pair of polepieces configured to apply the magnetic field to the MR fluid to increase viscosity of the MR fluid.

The MR fluid may contain a dispersion medium in addition to the coloring agent and the magnetic particles. Further, the coloring agent contained in the MR fluid can be at least one dye. The dye can generally be any type of dye. Examples of types of dyes include cationic dyes, anionic dyes, acid dyes, basic dyes, mordant dyes, azoic dyes, reactive dyes, sulfur dyes, and vat dyes.

In the dyeing method, the MR fluid and/or the material may be provided continuously to the contacting surface. In the dyeing apparatus, the providing device may comprise a nozzle configured to continuously provide the MR fluid. The fluid can be provided continuously or discontinuously.

In the dyeing method, contacting the material with the MR fluid may comprise positioning the material and the MR fluid between the contacting surface and the opposing surface. In the dyeing apparatus, the contacting surface and the opposing surface may be configured to position the material and the MR fluid between the contacting surface and the opposing surface. The material and the MR fluid may be pressed against each other, thereby facilitating the dyeing.

In the dyeing method and apparatus, the contacting surface and/or the opposing surface may be a convex surface (as viewed from outside). In one example, both the contacting surface and the opposing surface may be convex surfaces. In a different example, one of the contacting surface and the opposing surface is a convex surface, while the other is a concave surface. In yet an additional example, one of the contacting surface and the opposing surface is a convex surface, while the other is neither convex nor concave. Furthermore, in the dyeing method, the MR fluid may be conveyed on the contacting surface by rotation of a roller, wherein the roller comprises the contacting surface. The dyeing apparatus may comprise a pair of rollers, wherein one of the rollers comprises the contacting surface on its side and the other roller comprises the opposing surface on its side. The pair of rollers may be configured to convey the MR fluid and the material on the contacting surface by rotation of the pair of rollers.

In the dyeing method, when the material is fabric or textile, the average particle size of the magnetic particle can be larger than the average gap width between adjacent yarns in the material. With this configuration, the magnetic particle can be prevented from remaining in the material due to its large size.

In the dyeing method, the magnetic particles can comprise nickel, cobalt, iron, or mixtures thereof.

In the dyeing method, providing the MR fluid onto the contacting surface can comprise pumping the MR fluid onto the contacting surface. In the dyeing apparatus, the providing device can comprise a pump configured to pump the MR fluid to the nozzle. The pumping can be performed continuously or discontinuously.

The dyeing method can further comprise removing the MR fluid from the contacting surface. One example of how the MR fluid can be removed is by providing a vacuum. An alternative example of how the MR fluid can be removed is by contacting a wiper blade near or against the contacting surface. The dyeing method can further comprise collecting the MR fluid removed from the contacting surface. In the dyeing method, providing the MR fluid onto the contacting surface can comprise providing the collected MR fluid onto the contacting surface in order to reuse or recycle the MR fluid. The dyeing apparatus can further comprise a removing device configured to remove the MR fluid from the contacting surface, such as optionally by providing a vacuum or providing a wiper blade. The dyeing apparatus can further comprise a reservoir or tank configured to collect the MR fluid removed from the contacting surface. The tank can be connected to the providing device so as to provide the collected MR fluid onto the contacting surface. Such a method and an apparatus can re-circulate the MR fluid, resulting in reduction of the amount of waste fluid.

The dyeing method may further comprise adjusting a concentration of at least one component of the collected MR fluid, wherein providing the MR fluid onto the contacting surface comprises providing the MR fluid after adjusting the concentration of at least one component of the collected MR fluid. The dyeing apparatus may further comprise an adjustment device configured to adjust a concentration of at least one component of the collected MR fluid. Even if components such as the coloring agent and the magnetic particles in the MR fluid are reduced as a result of, for example, being adsorbed onto the material, the concentration of components can be adjusted in a specific range by, for example, supplying components to the tank. The apparatus may further comprise at least one detector to monitor the concentration of the at least one component or the collected MR fluid.

The dyeing method can further comprise swelling the material with a swelling agent prior to contacting the material with the MR fluid. The dyeing apparatus can further comprise at least one swelling device configured to swell the material with a swelling agent. The swelling device can also include at least one reservoir to hold the swelling agent. The swelling agent can comprise tetraethylene glycol dimethyl ether.

The dyeing method can further comprise fixing the coloring agent to the dyed material. The dyeing apparatus can further comprise at least one fixing device configured to fix the coloring agent on the dyed material. Fixing the coloring agent on the material can be performed by a variety of methods, two examples including heating the dyed material or immersing the dyed material in a fixative. The fixing device can also include at least one reservoir to hold the fixative.

After dyeing, the dyed material may have some magnetic particles remaining in or on the material. Any remaining magnetic particles can easily be removed by application of a magnetic force to the material. Any removed magnetic particles may be disposed, collected, or reused. An apparatus may further include a magnetic field applicator configured to remove magnetic particles from the dyed fabric. The material such as fabric and textile can be brought into contact with the MR fluid while being kept in a flat state without crinkling.

BRIEF DESCRIPTION OF THE FIGURES

FIGS. 2A-2C are enlarged views each showing a portion of an illustrative embodiment of an apparatus for dyeing material.

DETAILED DESCRIPTION

Figure 1:
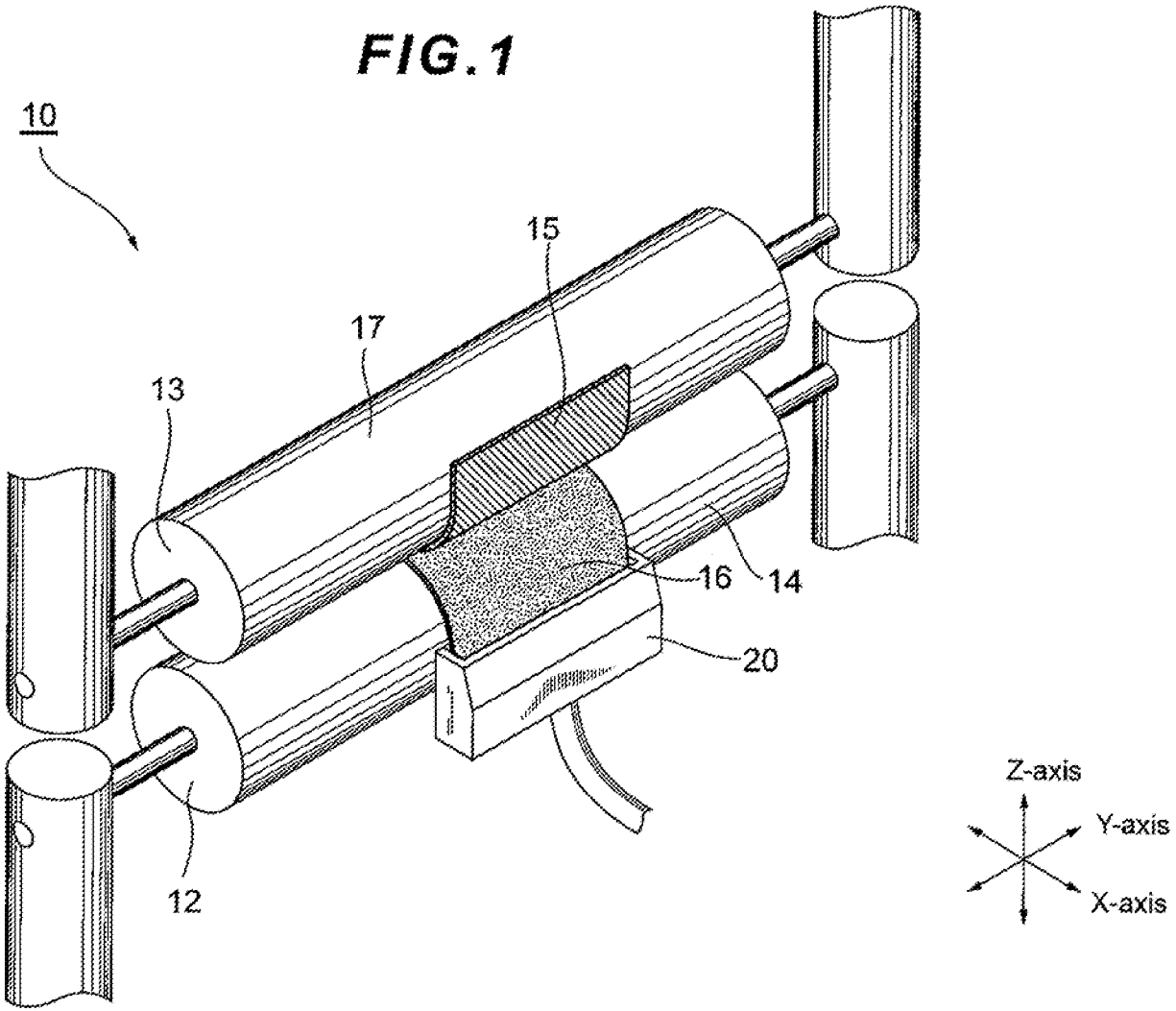
FIG. 1 is a perspective view of an illustrative embodiment of an apparatus for dyeing material.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, may be arranged, substituted, combined, separated, and designed in a wide variety of different configurations, all of which are explicitly contemplated herein.

Methods, apparatuses and compositions for dyeing material are disclosed.

The method for dyeing material according to the embodiments described herein includes, but is not limited to, providing a magnetorheological ("MR") fluid including at least one coloring agent to a contacting surface, applying a magnetic field to the MR fluid sufficient to increase viscosity of the MR fluid, and providing the material to the contacting surface such that the coloring agent in the MR fluid dyes the material to produce a dyed material.

As used herein, the material may be a liquid-absorbable or non-absorbable material. The material may be made of, but not limited to, natural materials or fibers such as cellulose, proteins and collagen; and synthetic materials or fibers such as polyamides, polyesters, polyvinyl chloride and polyurethanes. The material may be, but not limited to, fabrics obtained by weaving fibers such as wool, cotton, silk and synthetic fibers. The material may be, but not limited to, textiles obtained by weaving, knitting, crocheting, knotting or pressing fibers together. The material may be, but not limited to, papers, natural or artificial leathers, feathers or porous artificial articles such as a sponge. Examples of the material include, but are not limited to, clothes such as gloves, coats, dresses, socks, gowns, caps, hats, jackets, neckties, scarves, skirts, suits, aprons, shirts, T-shirts, sweaters, vests, pants, jeans and underwears; containers such as bags; carpets; window shades; towels; bedsheets; coverings for tables; flags; and handkerchiefs. Hereafter, an example using fabric as a material is described, but the use is not intended to be limited by the example.

The dyeing method may include one or more pretreatments, such as swelling the fabric. This treatment reduces the gap between yarns contained in the fabric, for example, thereby reducing the magnetic particles remaining in the fabric after dyeing. The method of swelling fabric is not particularly limited, and an example of the method is a method described in Technical Information No. 451 (September 2001) of Industrial Technology Center of Okayama Prefecture. In this method, tetraethylene glycol dimethyl ether (TEGDME) is used as a fiber swelling agent. TEGDME is added to a 1% aqueous solution of sodium carbonate to prepare a 10% to 50% solution of TEGDME. A fabric to be dyed is immersed in the obtained solution for, e.g., 30 minutes, and then dehydrated and dried. As a result, a swelled fabric can be obtained. Note that swelling agents are not particularly limited as long as they are used for the purpose of swelling fabric, and known swelling agents may also be used.

In the dyeing method, the fabric (optionally pre-swelled) is at least partially or completely brought into contact with the MR fluid. The portion of the fabric which makes contact with the fluid may or may not be moved, whereby the fabric can be dyed with the coloring agent contained in the MR fluid. When a magnetic field is applied to the MR fluid, the viscosity of the MR fluid is increased, resulting in a "damping effect". The damping effect means an effect of distributing the pressure of the MR fluid on the fabric. The higher the viscosity of the MR fluid becomes, the higher the uniformly distributed pressure on the fabric becomes. For example, when a magnetic field of 50 A/m is applied to a MR fluid having a viscosity of 150 cps at 25° C. with no magnetic field, the viscosity of MR fluid may become as high as about 2000 cps. The viscosity may become as high as about 11000 cps, about 18000 cps and about 24000 cps when magnetic fields of 100 A/m, 150 A/m and 200 A/m are applied to the MR fluid, respectively. The viscosity of the magnetized MR fluid may be within the range from about 100 cps to about 50000 cps. The viscosity may be controlled by adjusting the strength of the magnetic field. Alternatively, the viscosity may be controlled by adjusting the temperature, where higher temperatures typically reduce the viscosity.

Figure 3A:
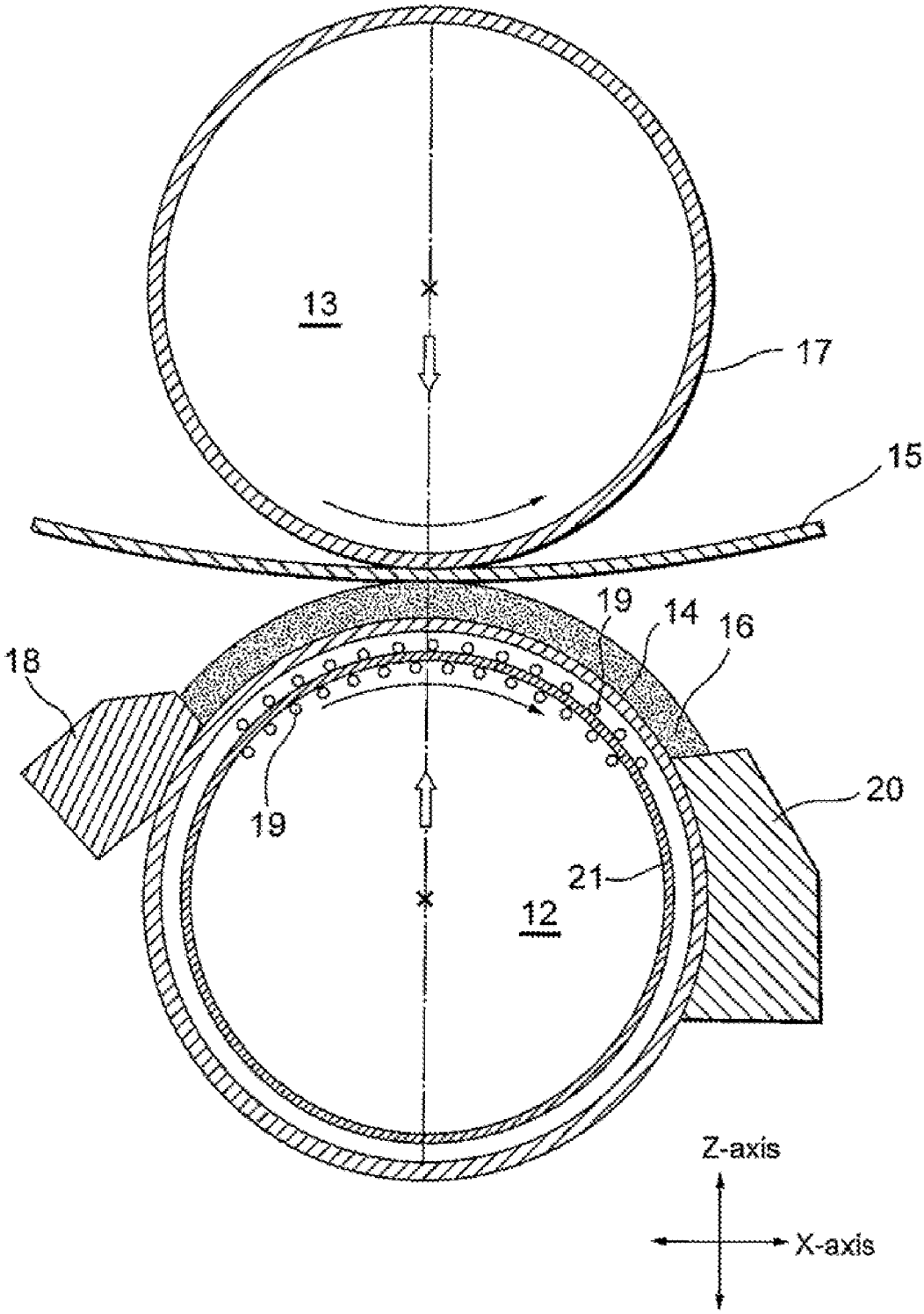
FIG. 3A is an enlarged cross-sectional view showing a portion of the apparatus of FIG. 2A.

FIGS. 1-2 and 3A each show an example of an illustrative embodiment of a dyeing apparatus that may be used for the dyeing method. FIG. 1 is a perspective view schematically showing the main part of the dyeing apparatus. FIGS. 2A-2C are schematic diagrams of the dyeing apparatuses in which the surfaces of opposite rollers which face carrier rollers have a convex shape, flat shape and concave shape, respectively.

Turning now to FIGS. 1 and 2A, a dyeing apparatus 10 is shown with a carrier roller 12 having a rotation axis in the Y-direction. The carrier roller 12 includes a contacting surface 14 that receives a MR fluid 16. In a non-limiting example, a fluid providing nozzle 18 may be located adjacent to the contacting surface 14 of the carrier roller 12 to provide the MR fluid 16. The width of the MR fluid 16 on the contacting surface 14 may depend on, but not limited to, the size and shape of the fluid providing nozzle 18. Various types of fluid providing nozzles may be used. Shown in FIGS. 4A-4D are some examples of the fluid providing nozzle. The shape of the fluid providing nozzle may generally be any shape, such as a square-like tube (see FIG. 4B, which corresponds to the fluid providing nozzle 18) or a cylindrical tube (see FIG. 4A). The fluid providing nozzle may have a plurality of nozzle openings arranged generally in any configuration, such as circularly (see FIG. 4C) or linearly (see FIG. 4D).

Referring again to FIGS. 1 and 2A, the MR fluid 16 provided on a portion of the contacting surface 14 may travel to the opposite portion of the contacting surface 14 by the rotation of the carrier roller 12. At the opposite portion, the MR fluid 16 may be optionally collected by a fluid collector 20. The various types of fluid collector 20 may also be used. Various shapes and sizes of the fluid collector 20 can be used. The carrier roller 12 conveys the MR fluid 16 through the gap between the contacting surface 14 and a guiding surface 17 of an opposite roller 13. The size of the gap may be adjusted depending on the total thickness of the MR fluid 16 and the fabric 15. For example, the gap may range, but not limited to, from about one times to about five times as large as the thickness of the fabric 15. The carrier roller 12 may be made of a non-magnetic material such as aluminum alloy, magnesium alloy, plastics or austenite stainless steel. The size and the surface structure of the carrier roller 12 are not limited to those described above, and can vary in size and shape depending on the material to be dyed.

The dyeing apparatus 10 can be provided with the opposite roller 13, which has a rotation axis in the Y-direction. The opposite roller 13 includes the guiding surface 17 that is the periphery of the opposite roller 13. The contacting surface 14 of the carrier roller 12 and the guiding surface 17 of the opposite roller 13 position the MR fluid 16 and fabric 15 to press them against each other (the arrows in FIG. 3). The opposite roller 13 sends out, by its rotation, the fabric 15 together with the MR fluid 16 through the gap between the contacting surface 14 and the guiding surface 17. The opposite roller 13 may also be made of a non-magnetic material such as aluminum, magnesium, plastics or austenite stainless steel.

The carrier roller 12 can be in the form of, but not limited to, a cylindrical shape. This shape of the carrier roller 12 may provide line contact between the MR fluid 16 on the carrier roller 12 and the fabric 15 guided by the opposite roller 13 along the rotation axis (i.e., the Y-direction). In some embodiments, the opposite roller 13 may be substituted with a member 22 having a flat surface 23 which is opposed to the carrier roller 12 (see FIG. 2B); or a member 24 having a concave curved surface 25 facing the contacting surface 14 of the carrier roller 12 (see FIG. 2C). The line-contact may enhance a pressing force of the MR fluid 16 against the fabric 15, thereby facilitating diffusion and adsorption of the coloring agent with respect to the fabric 15. Further, a contacting area in the line contact may transit smoothly in accordance with the rotation of the carrier roller 12. As a result, dyeing can be carried out more evenly. The various rollers may have smooth surfaces or patterned surfaces. The patterned surfaces may be regular or irregular patterned.

The term "line contact," as used throughout the specification, is intended to include the meaning of a two-dimensional width in practical use.

The opposite roller 13 can also be in the form of, but not limited to, a cylindrical shape. This shape allows the MR fluid 16 and the fabric 15 to make line-contact between the carrier roller 12 and the opposite roller 13 even if the carrier roller 12, which positions the MR fluid 16 and the fabric 15 together with the opposite roller 13, is replaced by: a member having a flat surface which is opposed to the opposite roller 13 in the same way as the surface 23 of the member 22; or a member which is opposed to the opposite roller 13 and has a surface curved in a concave shape in the cross section (X-Z cross section) of the member in to the same way as the surface 25 of the member 24 shown in FIGS. 2B and 2C.

The magnetic field to be applied to the MR fluid 16 may be created by generally any type of magnet. Two examples of types of magnets are electromagnets and permanent magnets. The magnetic field may be applied by one magnet or by multiple magnets. The multiple magnets may be the same type of magnets or different types of magnets. The magnetic field may be controlled by the magnitude of electrical current through an electromagnet. For example, the magnetic field may be created by a DC electromagnet, which is provided with a coil 19 (see also FIG. 3A). The coil 19 may be wound around a core 21 located under the contacting surface 14. The core 21 may have a cylindrical shape. The wound coil 19 may be sized so that a size in the Y-direction is approximately equal to or larger than the width of the MR fluid 16, and a size in the circumferential direction of the carrier roller 12 does not extend beyond the area occupied by the contacting surface 14. The coil 19 may be optionally positioned under the contacting surface 14 of the carrier roller 12 so that the created magnetic field can efficiently be applied to the MR fluid 16. The configuration of the electromagnet including the coil 19 is not limited, to the extent that the magnetic field can be applied to the MR fluid 16 to control the viscosity of the MR fluid 16. Thus, the MR fluid 16 traveling on the contacting surface 14 passes through the fringing field.

Figure 3B:
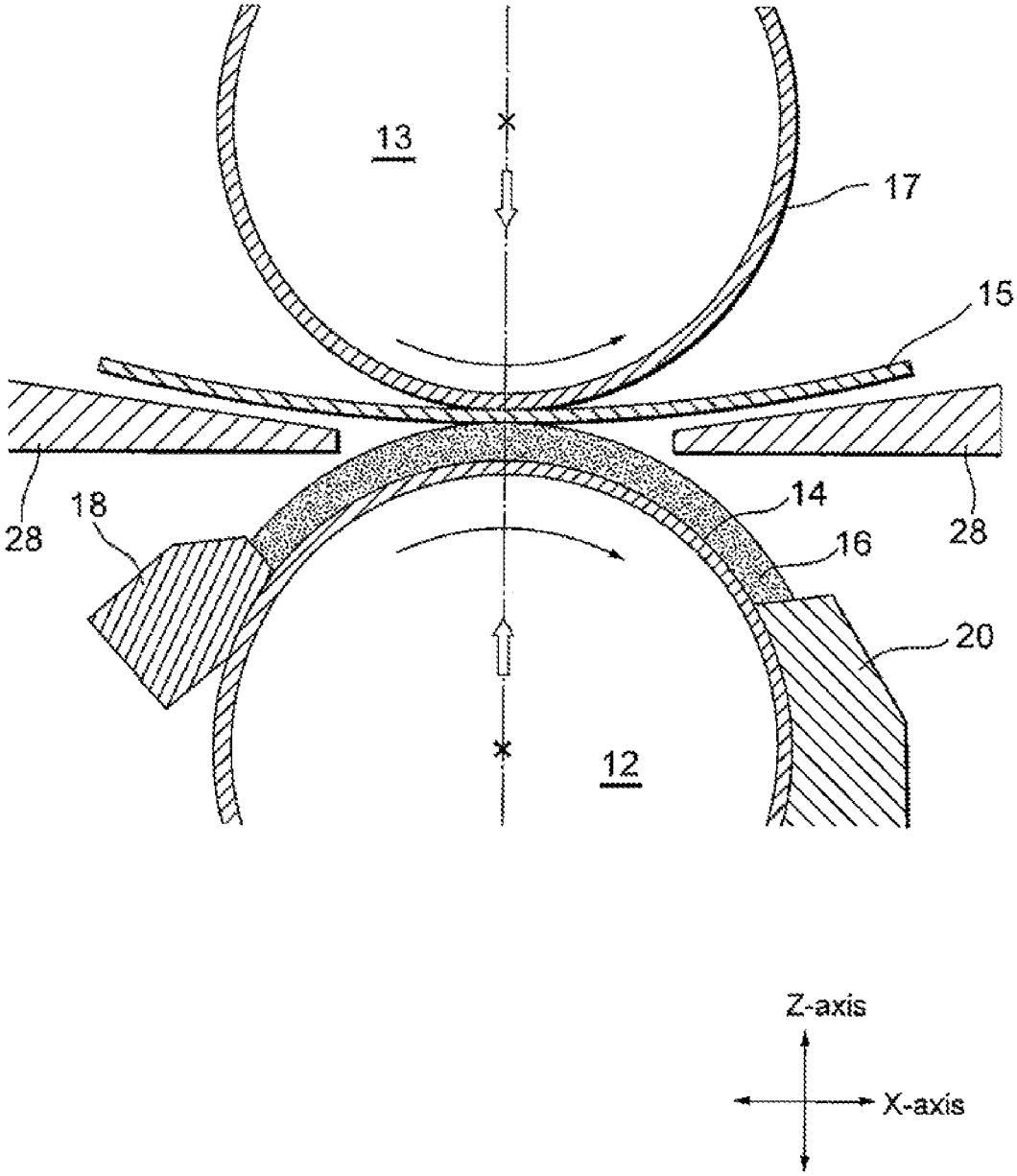
FIG. 3B is an enlarged cross-sectional view showing a portion of an another illustrative apparatus.
Figure 4A:
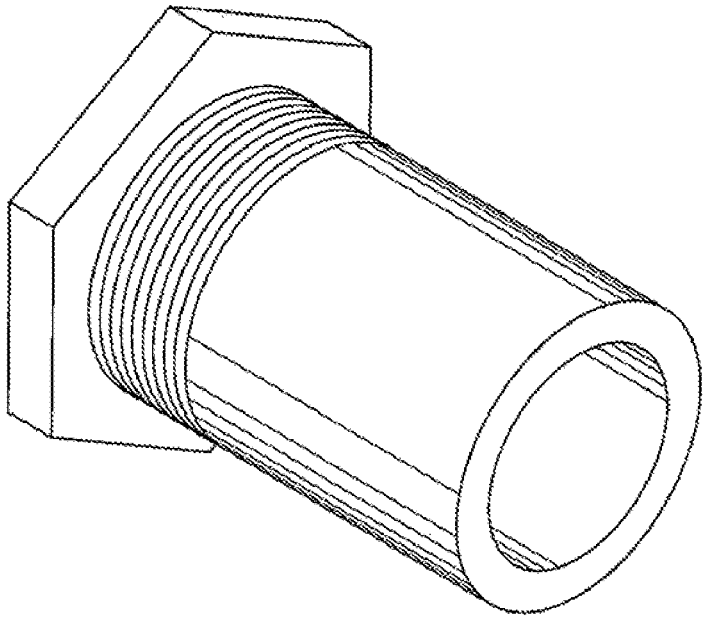
FIGS. 4A-4D are perspective views of various nozzles of an illustrative embodiment of an apparatus for dyeing material.
Figure 4B:
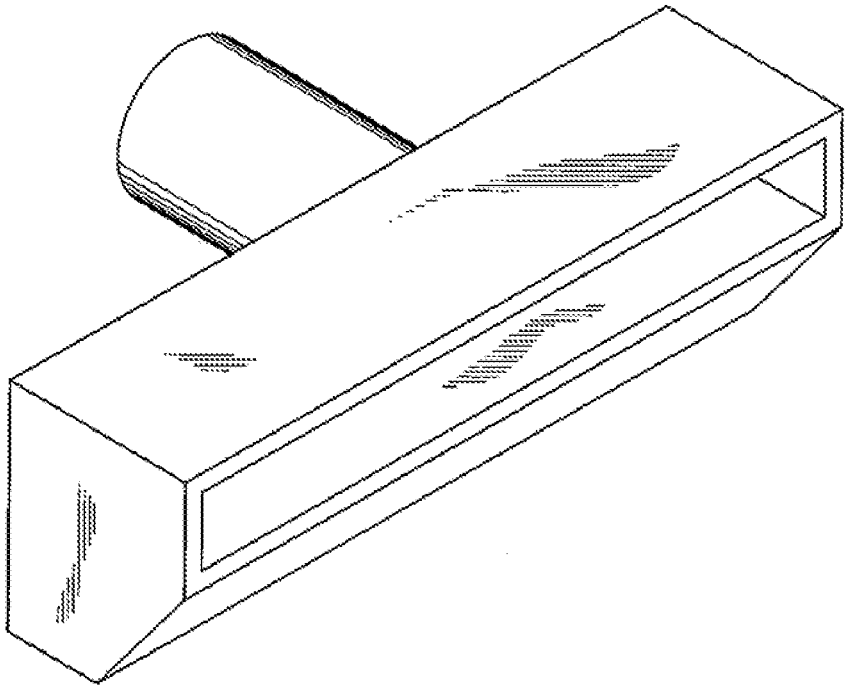
Figure 4C:
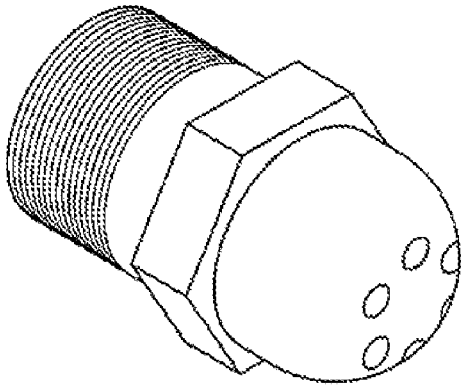
Figure 4D:
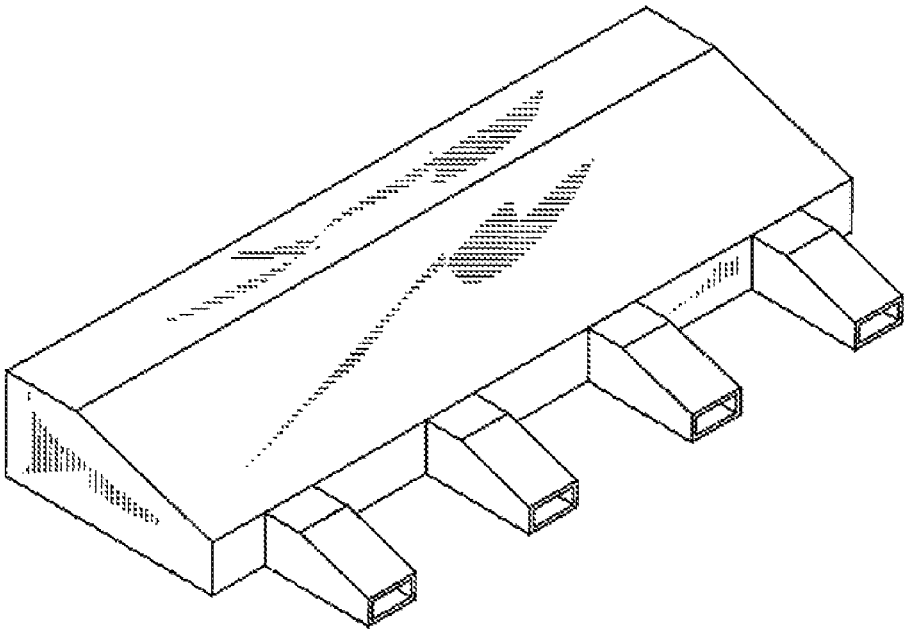

FIG. 3B is an enlarged cross-sectional view showing a portion of another illustrative apparatus in which a pair of yokes 28 replaces the coil 19 in the apparatus of FIG. 2A. The pair of yokes 28 may serve as magnetic polepieces so as to form a closed magnetic circuit. The pair of yokes 28 may have a size in the Y-direction approximately equal to or larger than the width of the MR fluid 16. The pair of yokes 28 may be configured to efficiently apply the magnetic field into the MR fluid 16. Although not shown in FIG. 3B, the magnetic field may be created by, but not limited to, a DC electromagnet electromagnetically connected to the yokes 28. Thus, the MR fluid 16 may be subjected to a variable strength of the magnetic field, whereby the MR fluid 16 may be adjusted to have an appropriate viscosity. Variable strength magnetic fields may also be achieved by other methods, such as by having movable magnets that can be moved towards or away from the MR fluid 16.

In the above example, since the line contact is made between the fabric 15 and the MR fluid 16 to cause the fabric 15 to be dyed while the fabric 15 and the MR fluid 16 are being conveyed, the MR fluid 16 can be pressed firmly against the fabric 15 even with a smaller pressing force than that for the case of plane contact.

As described above, the apparatus and method of magnetizing the MR fluid 16 can be varied considerably while staying within the scope of this application. The apparatus can be created on a custom basis, or can be made by modifying commercially available machines.

In an example, the MR fluid 16 (i.e., the composition for dyeing the material) may contain magnetic particles and at least one coloring agent, and may also contain a dispersion medium. The type of magnetic particles are not particularly limited. In an example, the materials of the magnetic particles include, but are not limited to, Ni, Co, Fe; an alloy of any of these elements; an alloy containing, as its main constituent, any of these elements; and an oxide, nitride, carbide and carbonyl of any of these elements. When Ni, Co, an alloy of any of these elements, or an alloy containing, as its main constituent, any of these elements is used for the magnetic particles, such particles each can form a dense oxide film on a surface thereof. Therefore, those magnetic particles are stable with respect to the MR fluid 16 even when it presents acidity or alkalinity depending on the kind of the coloring agent, thereby allowing reduced or eliminated corrosion of the magnetic particles. Examples of materials for such magnetic particles include, but are not limited to, $MnZn.Fe_2O_3$, $BaO.6Fe_2O_3$, $NiZn.Fe_2O_3$, $Co\gamma.Fe_2O_3$, $\gamma.Fe_2O_3$ and permalloy. One kind of magnetic particles may be used alone, or two or more thereof may be used in combination.

The particle size (i.e., average particle size) of the magnetic particle is not particularly limited. For example, the particle size may be approximately 10 μm or less, 0.1-10 μm, 1-10 μm, or 35 μm. The particle size larger than the gap width between yarns (fibers) of the fabric may reduce or prevent the magnetic particles from remaining in the fabric after dyeing. Such a particle size may be, for example, 20 μm or larger. In some embodiments, the larger the particle size becomes, the easier it is to visually detect a portion of the fabric where the magnetic particle is not in contact with and thus dying may be insufficient. As a result, the color unevenness of the fabric, which arises from the presence of the undyed part, tends to be easily located by eye or by a detector.

Various dyes and pigments may be employed as the coloring agent. Known coloring agents for fabric may be used. Many fabric dyes are commercially available in large quantities. Examples of the dyes include, but are not limited to, direct dyes such as, but not limited to, sodium salt of color acid having a sulfo group; acid dyes such as sodium salt of color acid having an acid group such as a sulfo group or a carboxyl group; base dyes in which an amino group such as $—NH_2$, —NHR or $—NR_2$ (R being an organic group having an aromatic ring) form an acidic constituent such as hydrochloric acid and salt; mordant dyes; acid mordant dyes; vat dyes such as an indanthrene dye or a threne dye, disperse dyes such as an azo dye and an anthraquinone dye; reactive dyes such as a Procion dye and a Remazol dye; and fluorescent whitening dyes such as a diaminostilbene dye, an imidazole dye, a coumarin dye, and a naphthalimido dye. Thus, the dye may be emulsified by a known method. The present disclosure may significantly contribute to reducing waste of unused dye, and accordingly use of the disclosed methods may reduce or eliminate the environmental impact of dyeing fabrics.

Inorganic pigments and organic pigments may also be used. Examples of the inorganic pigments include: black pigments such as carbon black; white pigments such as zinc white, lead white, lithopone, titanium dioxide, precipitated barium sulfate, and baryta powder, red pigments such as red lead and red iron oxide; yellow pigments such as chrome yellow and zinc yellow; and blue pigments such as ultramarine blue and Prussian blue. Examples of the organic pigments include: azo pigments such as a monoazo pigment, a diazo pigment, and a diazo condensation pigment; polycyclic pigments such as an anthraquinone pigment, a phthalocyanine pigment, a quinacridone pigment, a perylene pigment, a pyrrol pigment, an isoindolin pigment, an oxazine pigment, and a xanthene pigment; and a lake pigment. Furthermore, if the particle size (average particle size) of the pigment is smaller than the gap width between yarns (fibers) of fabric, the fabric tends to be dyed more evenly. Such a particle size may be, for example, about 10 μm or larger. The pigment can be a nanosized-particle pigment having a particle size of about 100 nm or smaller.

One kind of coloring agents can be used alone, or two or more different coloring agents can be used in combination.

The dispersion medium may be water, an aqueous solvent, a non-aqueous solvent, or mixtures thereof. Using water may reduce environmental issues such as increased VOC (Volatile Organic Compounds). Examples of the aqueous solvents include polyalkylene glycol and polyglycol. Examples of the non-aqueous (including water-insoluble solvents) include, but are not limited to, mineral solvents such as kerosene, gas oil and lubricant oil, n-paraffin, isoparaffin, alkyl benzene, alkyl naphthalene, poly-α-olefin, fluorohydrocarbon, silicone oil and polyphenyl ether. Esters such as polyol ester, diester and monoester can be used as the dispersion medium. One kind of dispersion media can be used alone, or two or more can be used in combination.

A dispersion medium can be used to have the MR fluid 16 exist as a fluid. The dispersion medium may be polar or nonpolar liquid. The kind and content of the dispersing medium may vary considerably.

Examples of polar dispersing medium used for forming a stable suspension of the magnetic particles include any kind of ester plasticizer for the polymer such as polyvinyl chloride. Such compounds may be commercially obtained. Examples of polar dispersion medium include polyesters of saturated fatty acid such as C6-12 hydrocarbon acid, dioctyl, phthalates such as dialkyl phthalate and trimellitates such as tri-n-octyl-triester and tri-n-decyl-triester. Other examples of carrier fluid (dispersion medium) include phthalate derivatives such as dialkyl or alkyl benzene orthophtalate, phosphate derivatives such as triallyl, trialkyl or alkylallyl phosphate, and epoxy derivatives such as epoxidized soybean oil.

Examples of nonpolar dispersing medium include hydrocarbon oil especially such as poly-α-olefin having low vaporizability and low viscosity. One example is SYN. THANE oil having viscosity of 2, 4, 6, 8 or 10 cSt manufactured by the Gulf Oil Company.

The concentration of the coloring agent in the MR fluid 16 may be adjusted higher or lower depending on the desired darkness of dyeing, and can be readily optimized. The concentration of the coloring agent may be, for example, about 0.5% to about 10% by mass, or about 1% to about 5% by mass with respect to the total volume of the MR fluid 16.

The concentration of the magnetic particles in the MR fluid 16 may be a concentration that attains a desired viscosity of the magnetized MR fluid 16, taking into consideration the coloring agent as well as the dispersion medium and various components blended as desired. The viscosity of the MR fluid 16 can generally be any viscosity. Example viscosities can be in the range of about 100 cps to about 50000 cps or about 100 cps to about 800 cps in the presence of the magnetic field at the temperature during dyeing. The temperature during dyeing can generally be any temperature. Example temperatures ca be, but not limited to, in the range of about 15° C. to about 100° C., and can be, but not limited to, about 25° C. The temperature can be room temperature, higher than room temperature, or lower than room temperature. The viscosity may be selected in consideration of fixing the fluid on the contacting surface, and uniform dyeing. The viscosity can be easily optimized for the particular material and dye combination. The concentration of the magnetic particles can generally be any concentration. Example concentrations may be, for example, about 1% to about 80% by mass, about 1% to about 20% by mass, about 1% to about 10% by mass, or about 3% to about 4% by mass with respect to the total mass of the MR fluid 16.

The concentration of the dispersion medium in the MR fluid 16 may be a concentration that attains a desired viscosity of the magnetized MR fluid 16, taking into consideration the coloring agent and the magnetic particles as well as the various components blended as desired. The concentration of the dispersion medium can be easily optimized. The concentration of the dispersion medium may be, for example, about 10% to about 90% by mass with respect to the total mass of the MR fluid 16.

Further, the MR fluid 16 may contain various components other than the magnetic particles, the coloring agent, and the dispersion medium. Examples of such components include surfactants such as anion surfactant, cation surfactant, nonion surfactant and ampholytic surfactant, dispersion stabilizers such as clay mineral dispersion stabilizer, viscosity modifier including polar solvents such as lower alcohol and ketone, and antioxidant such as aromatic amines.

The magnetic particles in the MR fluid 16 each may have a large number of magnetic domains. When a magnetic field is not being applied to the magnetic particles, the magnetic domains are in random directions, and the magnetic particles are not magnetized. Thus, the magnetic particles are dispersed relatively evenly in the MR fluid 16. The MR fluid 16 that has not been magnetized typically behaves as a Newtonian fluid. In contrast, in the MR fluid 16 to which a magnetic field has been applied from the outside, the magnetic domains of the magnetic particles are oriented in the direction of the magnetic-field, and the magnetic particles then polarize magnetically, which generates a bonding force between the particles, thereby forming a crosslinked structure (cluster). The cluster causes flow resistance, which increases the viscosity of the MR fluid 16. The magnetized MR fluid 16 behaves as a Bingham fluid having a yield stress value. The yield stress value depends on the binding force between the magnetic particles. Therefore, the viscosity of the MR fluid 16 can be controlled by adjusting the amount of the magnetic field. The strength of the magnetic field can generally be any value. The amount of the magnetic field can be for example, but not limited to, from about 0.01 Tesla to about 0.45 Tesla.

Figure 5:
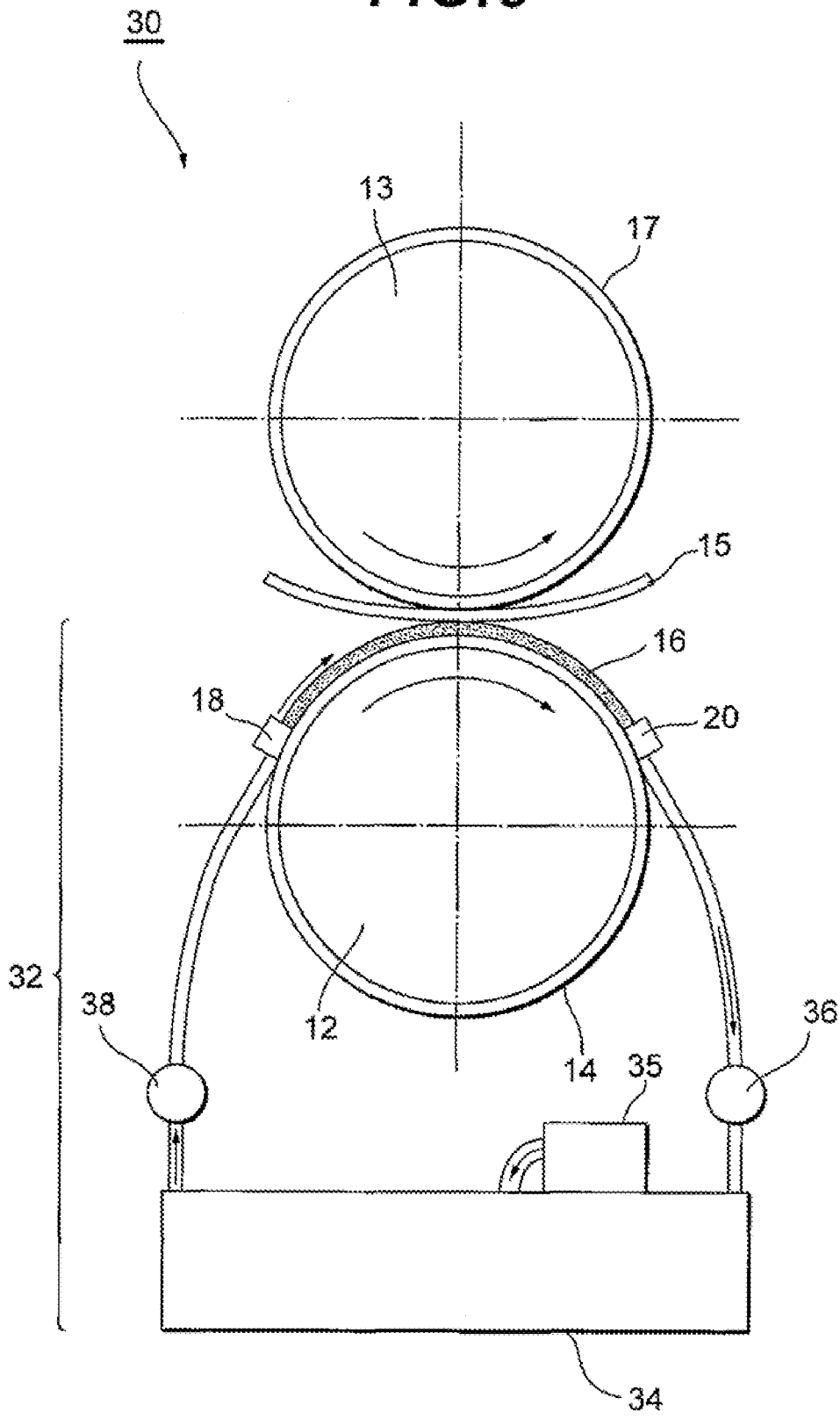
FIG. 5 is a schematic diagram of an illustrative embodiment of an apparatus for dyeing material including an illustrative embodiment of a fluid circulation system.

The dyeing apparatus of the embodiment may include a fluid circulation system. The fluid circulation system can be obtained commercially, or easily assembled using commercially available parts. FIG. 5 is a schematic diagram showing an example of a dyeing apparatus 30 including a fluid circulation system. The dyeing apparatus 30 is provided with a fluid circulation system 32. The fluid circulation system 32 may include: a fluid providing nozzle 18; a fluid collector 20; a fluid tank 34 for storing the MR fluid 16; a collection pump 36 for feeding the MR fluid 16 from the fluid collector 20 to the fluid tank 34; and a providing pump 38 for feeding the MR fluid 16 from the fluid tank 34 to the fluid providing nozzle 18. Further, as with the dyeing apparatus 10 shown in FIG. 1, the dyeing apparatus 30 is provided with the carrier roller 12 and the opposite roller 13, and is further provided with the fluid providing nozzle 18 and the fluid collector 20. The fluid circulation system 32 may provide the MR fluid 16 to the carrier roller 12 shown in FIG. 1, and also may provide the MR fluid 16 to a member that continuously conveys any other MR fluid in place of the carrier roller 12.

In order to decrease or eliminate discoloration associated with the evaporation of the liquid component and deterioration of the dye in the MR fluid due to contact with air, the MR fluid 16 may optionally be prevented from being exposed to the atmosphere in areas other than the area on the carrier roller 12 in the fluid circulation system 32.

The MR fluid 16 may be pressurized by one or more of the providing pumps 38 and delivered from the fluid tank 34 to the fluid providing nozzle 18. The rate of providing the MR fluid 16 with respect to the rotational speed of the carrier roller 12 may in part impact the thickness of the MR fluid 16 on the contacting surface 14 of the carrier roller 12. When the rate of providing the MR fluid 16 is high and the speed of the contacting surface 14 is low, the MR fluid 16 may become thick on the carrier roller 12. Therefore, the dyeability of the coloring agent on the fabric 15 may be enhanced. It would be anticipated that the rate Q of providing the MR fluid ($cm^3$/sec) is equal to the product of the cross section S ($cm^2$) and the linear speed V (cm/sec) of the MR fluid on the carrier roller 12. That is, $Q=S\times V$ is established.

Figure 6A:
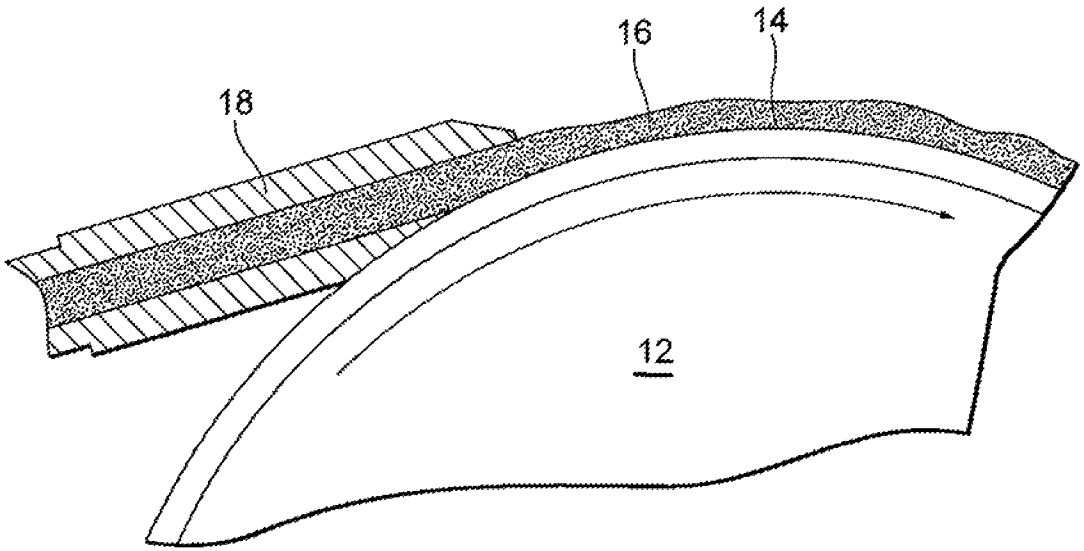
FIGS. 6A-6B are schematic diagrams of an illustrative embodiment of a fluid providing nozzle.
Figure 6B:
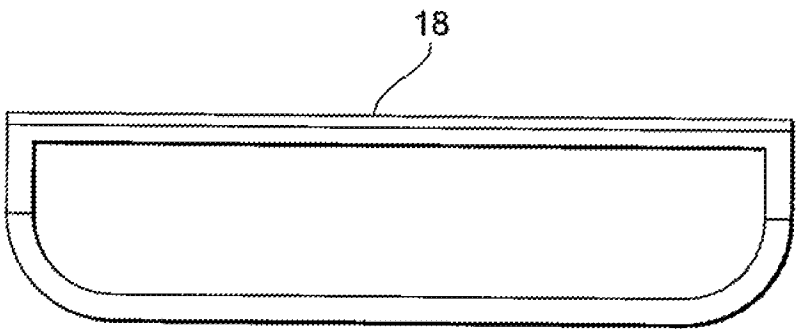

The fluid providing nozzle 18 may have a shape capable of providing a sufficient amount of the MR fluid 16 to dye the fabric 15. An example of the fluid providing nozzle 18 is shown in FIGS. 6A and 6B. FIG. 6A is a cross-sectional view schematically showing the state in which the MR fluid 16 flows out of the fluid providing nozzle 18 to be provided on the carrier roller 12. FIG. 6B is a schematic diagram showing the shape of an opening of the fluid providing nozzle 18. The fluid providing nozzle 18 may include a magnetically soft material such as iron. The nozzle with low magnetic energy may fully or partially shield the MR fluid 16 from the magnetic field, and, as a result, reduce or prevent an increase of the viscosity of the MR fluid 16 before the MR fluid 16 is ejected from the nozzle. The fluid providing nozzle 18 and a fluid providing tube operatively connected to the nozzle 18 may provide a lamellar flow of the MR fluid 16. The tip of the fluid providing nozzle 18 may be tapered inwardly. The opening of the fluid providing nozzle 18 may or may not have direct contact with the contacting surface 14 of the carrier roller 12. In the case of direct contact, applying a coating of polytetrafluoroethylene, silicone resin, or the like onto the surface of the contacting surface 14 is advantageous for preventing wear of contacting surface 14. The opening may be tangential to the contacting surface 14.

Further, the cross-sectional shape of the MR fluid 16 on the carrier roller 12 may be controlled by variously changing the shape of the upper portion of the opening of the fluid providing nozzle 18, whereby various dyeing patterns may be applied onto the fabric 15. For example, a serrated upper portion of the opening allows the MR fluid 16 to be extruded in the shape of serrations, and therefore, dyeing with strip patterns may be carried out. The fluid providing nozzle 18 shown in FIG. 4C or 4D may enable the dyeing apparatus 10 to create various patterns with different colors.

Figure 7A:
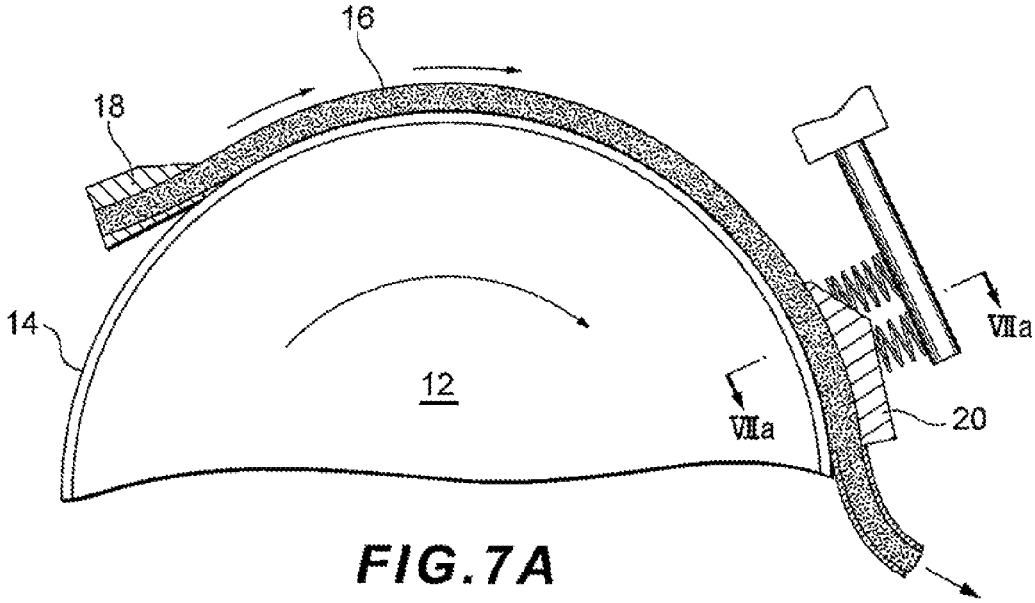
FIGS. 7A-7C are schematic diagrams of an illustrative embodiment of a fluid collector.
Figure 7B:
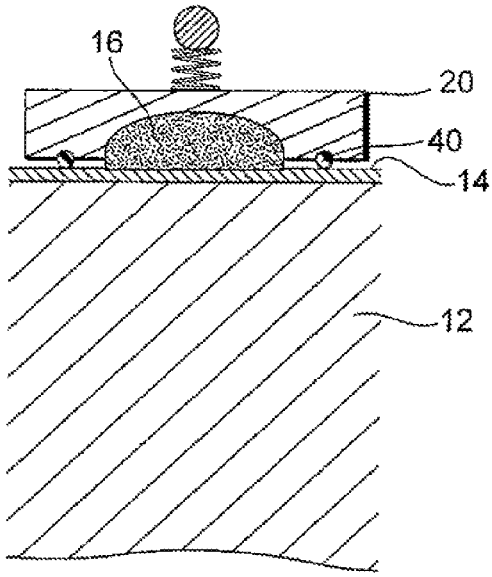
Figure 7C:
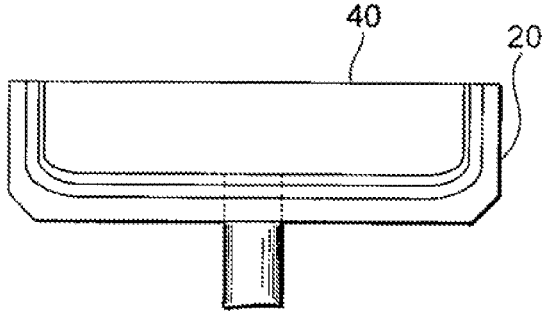

The fluid collector 20 may have a shape suitable for collecting the MR fluid 16. The fluid providing nozzle 18 may have, but not limited to, a shape as shown in, e.g., FIG. 7. FIG. 7A is a side cross-sectional partial view showing an example of the fluid collector 20. FIG. 7B is a cross-sectional view along line VIIa-VIIa in FIG. 7A. FIG. 7C is a bottom view of the fluid collector 20. By using a pickup scraper 40, which may be made of rubber, flexible plastic, or other flexible materials, the fluid collector 20 may separate the MR fluid 16 from the surface of the carrier roller 12. The pickup scraper 40 may be designed to conform to the surface of the carrier roller 12. The pickup scraper 40 may form a cup-like shape or U-shape and have an opening through which the MR fluid 16 enters. The fluid collector 20 may be operatively connected to one or more collection pumps 36 for drawing in the MR fluid 16. The fluid collector 20 may include, or be covered by, a magnetic shield of a material with low magnetic energy such as iron. The magnetic shield may shield the MR fluid 16 from the surrounding magnetic field so as to allow the MR fluid 16 to return to a less viscous state.

In the fluid circulation system 32, using peristaltic pumps as the providing pump 38 and/or the collection pump 36 has an advantage that the contact portion between the MR fluid 16 containing magnetic particles and the pump components is reduced. In a peristaltic pump, only the portion subjected to the wear due to the MR fluid 16 corresponds to a short tube, which lasts through several hundred hours of use and may be replaced cheaply. The peristaltic pump itself is relatively inexpensive. This pump works at a low flow rate without the generation of gaps in the MR fluid 16. Two or more pumps may be used in parallel to adjust the pulsations that decrease their amplitude. Two three-headed pumps may be used as the providing pumps 38, and the drive heads may be offset by 60° with respect to each other.

MASTERFLEX® 6485-82 PharMed® tubing may be used for the suction portion of the fluid circulation system 32. IMPERIAL-EASTMAN ⅜ tubing can be used for the providing portion of the fluid circulation system 32. EASY LOAD MASTERFLEX® pumps, mod. no. 7529-00 can be used as the providing pumps 38. COLE-PALMER MASTERFLEX® pump, mod. no. 7019-25 may be used as the collection pumps 36. Permanent magnet motor mod. no. 2M168C, Dayton, may be used to drive the pumps together with DC Speed Controls mod. no. 5×485C, Dayton.

The MR fluid 16 may be vacuum-suctioned into the tube through the fluid collector 20 by one or more of the collection pumps 36, pressurized by the collection pumps 36; and sent to the fluid tank 34. APP NALGENE®, 1000 ml Seperatory Funnel may be used as the fluid tank 34. The MR fluid 16 may be sent to the fluid tank 34 with a sufficient force so as to be homogenized by breaking up any remaining magnetic particle structures created by the applied magnetic field. However, the fluid tank 34 may also or alternatively include an agitator or stirrer for this purpose. Laboratory stirrer TLINE, mod. no. 102 may be used for this purpose. Alternately, other mixing or homogenizing equipment may be used. The fluid tank 34 may be made of a nonmagnetic, wear-resistant material such as stainless steel, fiberglass, or plastic. Thus, the fluid tank 34 may have a conical or some other shape that provides no settling zones where the MR fluid 16 could aggregate. Also, the fluid tank 34 may be configured to allow the agitator that reaches the entire fluid tank 34 having a large volume to fit therein so as to leave no settling zone.

Referring to FIG. 5, the fluid circulation system 32 may include an adjustment device 35 configured to adjust a concentration of at least one component contained in the collected MR fluid 16. In an example, the adjustment device 35 may supply an amount of various components to the fluid tank 34. The components may include a coloring agent, magnetic particles, a dispersion medium and other components. Although not shown in FIG. 5, the adjustment device 35 may include a sensor to monitor the concentrations of the coloring agent, magnetic particles, dispersion medium and other components in the MR fluid 16 stored in the fluid tank 34. For example, the sensor may detect decrease in the coloring agent collected in the fluid tank 34 in accordance with dyeing for the fabric 15, so that the fluid tank 34 is supplied with the coloring agent as necessary from the adjustment device. Such operation applies also to the magnetic particles, dispersion medium and other components. The sensor may be for monitoring the viscosity of the MR fluid 16. When dyeing is continued, the viscosity of the MR fluid 16 is increased due to the reduction, through dyeing, of the dye serving as the coloring agent and the reduction of the liquid components such as the dispersion medium through volatilization. Therefore, a dye or dispersion medium may be added to the MR fluid 16 in order to maintain the viscosity of the MR fluid 16 within a certain range. The viscosity may be monitored using a pressure probe. A preferred pressure probe is a diaphragm sensor such as Cooper PFD 102. The MR fluid 16 containing the coloring agent that has been used once for dyeing can be reused using the fluid circulation system 32.

As discussed above, the MR fluid 16 may be conveyed continuously from the fluid providing nozzle 18 to the fluid collector 20 by the rotation of the carrier roller 12 on which the MR fluid 16 is provided. However, instead of the carrier roller 12, the MR fluid 16 may be conveyed continuously by a belt conveyor. In such cases, the MR fluid 16 may be supported by a substantially-flat surface of the belt conveyor. Further, instead of being conveyed continuously, the MR fluid 16 may be processed in a batch manner. In such a case, for example, the MR-fluid 16 is accommodated in a tray-shaped container, and a magnetic field is applied to the container, thereby magnetizing the MR fluid 16. The fabric 15 is then carried as discussed above, and may be dyed by being at least partially brought into contact with the magnetized MR fluid 16, as necessary while moving on the contact area between the fabric 15 and the magnetorhological fluid 16. In this case, the contact between the fabric 15 and the MR fluid 16 may not necessarily be line contact, and may be, for example, a surface contact.

The dyeing apparatus 10 may allow the fabric 15 to be dyed with various patterns or designs by, for example, controlling the range of application of magnetic fields. For example, the arrangement of the coils 19 under the contacting surface 14 is adjusted to control the range of application of magnetic fields so that the fabric 15 can be provided with a dyeing pattern. In another example, the fabric 15 may be dyed various patterns or designs by way of using one or more extrusion molds provided in the opening of the fluid providing nozzle 18. The extrusion mold may be attached at a part of the opening The size, shape and number of the extrusion molds are not limited and may be selected so as to be suitable for a desired pattern or design. For example, if dyeing with a stripe pattern is desired, an extrusion mold having serrations can be used. Further, the extrusion molds having different shapes may be provided in the fluid providing nozzle 18. The extrusion mold may be configured to be movable vertically and/or horizontally under preprogrammed control. In operation, the extrusion mold may be moved, thereby allowing the dyeing pattern or design to vary.

In the dyeing apparatus, a plurality of the fluid providing nozzles 18 may be arranged to eject the MR fluids 16 respectively containing coloring agents of different colors therefrom. As a result, a further wide variety of dyeing patterns and dyeing designs can be formed.

The dyed fabric 15 may be further subjected to post-dyeing treatments such as heat treatment or immersed in a bath of a fixative. As a result, the coloring agent is fixed on the fabric 15. For example, when a Mikasil dye is used as the coloring agent for the fabric 15 made of fiber such as polyester fiber or acetate fiber, the dye may be fixed on the fabric 15 through heating at 100° for about 60 minutes. Alternatively, when a copper azo compound is used as the coloring agent, the dye may be fixed on the fabric 15 by having the fabric 15 immersed in a bath of a fixative at 60° for about 20 minutes. Further, the dyed fabric 15 may be subjected to water-washing treatment. In the embodiment, the dye is prevented from being excessively adsorbed by and dispersed in the fabric 15, and therefore, water-control management and waste-water treatment after the water-washing treatment may also be facilitated.

With the above dyeing method and dyeing apparatus, a coloring agent can be adsorbed by the material efficiently. As a result, with the dyeing method, the material such as fabric and textile, but not limited to, can be dyed evenly with the economical use of a coloring agent, and also, it is possible for dyeing to be carried out with less burden on the environment. Magnetizing MR fluid increases the viscosity, resulting in a damping effect, which leads to an enhanced performance of retaining the coloring agent. Therefore, even when the magnetized MR fluid is brought into contact with the material by being pressed against the material, it may be more difficult for the magnetized MR fluid to flow in a direction perpendicular to the pressing direction. Meanwhile, the degree of the diffusion and adsorption of the coloring agent with respect to the material may show very little change before and after magnetization of the MR fluid. Accordingly, firmly pressing the magnetized MR fluid against the material makes it easy for the coloring agent to be evenly diffused in and adsorbed by the material, enabling dyeing to be carried out evenly, and also attains the economical use of the coloring agent and the reduction of dyeing time. Further, even if the absolute volume of each of the coloring agent and the dispersion medium is small, dyeing can be carried out evenly and also the amount of waste liquid can be reduced. The size of the dyeing apparatus can be reduced compared to a conventional apparatus. The material can be brought into contact with the MR fluid while being kept in a flat state without crinkling. Therefore, the method and the apparatus also enable dyeing to be carried out evenly.

The invention claimed is:

1. A method for dyeing material, the method comprising:

providing a material to be dyed;

providing a magnetorheological fluid onto a contacting surface, wherein the magnetorheological fluid comprises at least one coloring agent and magnetic particles;

applying a magnetic field to the magnetorheological fluid to increase viscosity of the magnetorheological fluid; and contacting the material with the magnetorheological fluid on the contacting surface to produce a dyed material, wherein contacting the material with the magnetorheological fluid comprises positioning the material and the magnetorheological fluid between a pair of opposing rollers, wherein at least one of the rollers comprises the contacting surface.

2. The method according to claim 1, further comprising:

conveying the magnetorheological fluid and the material on the contacting surface by rotation of the pair of opposing rollers.

3. The method according to claim 1, wherein contacting the material with the magnetorheological fluid further comprises positioning the material in line-contact with the magnetorheological fluid.

4. The method according to claim 3, wherein the contacting the material with the magnetorheological fluid further comprises positioning the material and the magnetorheological fluid between the contacting surface and an opposing surface, wherein at least one of the contacting surface and the opposing surface is a convex surface.

5. The method according to claim 1, further comprising removing the magnetorheological fluid from the contacting surface by providing a vacuum.

6. The method according to claim 5, further comprising collecting the magnetorheological fluid removed from the contacting surface.

7. The method according to claim 6, wherein providing the magnetorheological fluid onto the contacting surface comprises providing the collected magnetorheological fluid onto the contacting surface.

8. The method according to claim 6, further comprising adjusting a concentration of at least one component of the collected magnetorheological fluid to produce an adjusted fluid, and providing the adjusted fluid onto the contacting surface.

9. The method according to claim 1, wherein the average particle size of the magnetic particle is larger than a gap width between adjacent yarns contained in the material.

10. The method according to claim 1, further comprising swelling the material with a swelling agent prior to contacting the material with the magnetorheological fluid.

11. The method according to claim 10, wherein the swelling agent comprises tetraethylene glycol dimethyl ether.

12. An apparatus for dyeing material, comprising at least one providing device, at least one contacting surface and at least one opposing surface;

wherein the providing device is configured to provide a magnetorheological fluid onto the contacting surface, wherein the magnetorheological fluid comprises at least one coloring agent and magnetic particles, wherein the contacting surface is configured to apply a magnetic field to the magnetorheological fluid, wherein the magnetic field is selected to increase the viscosity of the magnetorheological fluid, wherein the opposing surface is configured to keep the material in contact with the magnetorheological fluid on the contacting surface to dye the material with the coloring agent, wherein the contacting surface and the opposing surface are configured to position the material and the magnetorheological fluid between the contacting surface and the opposing surface, and wherein the apparatus further comprises a pair of rollers, wherein one of the rollers comprises the contacting surface on the side thereof and the other roller comprises the opposing surface on the side thereof.

13. The apparatus according to claim 12, wherein the providing device comprises a nozzle configured to continuously provide the magnetorheological fluid.

14. The apparatus according to claim 13, wherein the providing device comprises a pump configured to pump the magnetorheological fluid to the nozzle.

15. The apparatus according to claim 12, wherein the pair of rollers is configured to convey the magnetorheological fluid and the material on the contacting surface by rotation of the pair of rollers.

16. The apparatus according to claim 12, wherein the contacting surface and the opposing surface are configured to maintain the material in line-contact with the magnetorheological fluid.

17. The apparatus according to claim 16, wherein the contacting surface and the opposing surface are configured to position the material and the magnetorheological fluid between the contacting surface and the opposing surface, and wherein at least one of the contacting surface and the opposing surface is a convex surface.

18. The apparatus according to claim 12, further comprising a removing device configured to remove the magnetorheological fluid from the contacting surface by providing a vacuum.

19. The apparatus according to claim 18, further comprising a tank configured to collect the magnetorheological fluid removed from the contacting surface.

20. The apparatus according to claim 19, wherein the tank is connected to the providing device so as to provide the collected magnetorheological fluid onto the contacting surface.

21. The apparatus according to claim 19, further comprising an adjustment device configured to adjust a concentration of at least one component included in the collected magnetorheological fluid.

22. The apparatus according to claim 12, further comprising a swelling device configured to swell the material with a swelling agent.

23. The apparatus according to claim 12, further comprising a pair of polepieces configured to apply the magnetic field to the magnetorheological fluid to increase viscosity of the magnetorheological fluid.

24. The apparatus according to claim 12, further comprising a fixing device configured to fix the coloring agent on the material.

25. The apparatus according to claim 24, wherein the fixing device comprises at least one of a heater and a fixative bath.

* * * * *

UNITED STATES PATENT AND TRADEMARK OFFICE

CERTIFICATE OF CORRECTION

PATENT NO. : 8,182,712 B1
APPLICATION NO. : 13/133614
DATED : May 22, 2012
INVENTOR(S) : Maekawa et al.

It is certified that error appears in the above-identified patent and that said Letters Patent is hereby corrected as shown below:

In Column 3, Line 27, delete “or the” and insert -- of the --, therefor.

In Column 7, Line 60, delete “35 μm.” and insert -- 3-5 μm. --, therefor.

In Column 9, Line 10, delete “SYN. THANE” and insert -- SYNTHANE --, therefor.

In Column 11, Line 67, delete “36;” and insert -- 36, --, therefor.

In Column 12, Line 1, delete “Seperatory” and insert -- Separatory --, therefor.

In Column 12, Line 55, delete “MR-fluid” and insert -- MR fluid --, therefor.

In Column 12, Line 61, delete “magnetorhological” and insert -- magnetorheological --, therefor.

Signed and Sealed this
Thirty-first Day of July, 2012

David J. Kappos

David J. Kappos
*Director of the United States Patent and Trademark Office*